US010145236B2

(12) United States Patent
Vitou

(10) Patent No.: US 10,145,236 B2
(45) Date of Patent: Dec. 4, 2018

(54) METHODS AND SYSTEMS FOR MONITORING A BLOWOUT PREVENTOR

(71) Applicant: Ensco International Incorporated, Wilmington, DE (US)

(72) Inventor: Christophe Vitou, Béziers (FR)

(73) Assignee: Ensco International Incorporated, Wilmington, DE (US)

( * ) Notice: Subject to any disclaimer, the term of this patent is extended or adjusted under 35 U.S.C. 154(b) by 115 days.

(21) Appl. No.: 14/865,787

(22) Filed: Sep. 25, 2015

(65) Prior Publication Data

US 2017/0089163 A1 Mar. 30, 2017

(51) Int. Cl.
*E21B 47/09* (2012.01)
*E21B 33/06* (2006.01)

(52) U.S. Cl.
CPC ..... *E21B 47/091* (2013.01); *E21B 33/063* (2013.01)

(58) Field of Classification Search
CPC ..... E21B 33/061; E21B 33/063
See application file for complete search history.

(56) References Cited

U.S. PATENT DOCUMENTS 4,799,827 A 1/1989 Jaqua
6,478,087 B2 11/2002 Allen
9,016,381 B2 * 4/2015 Dietz ..... E21B 21/08 166/344
2012/0275274 A1 * 11/2012 Gochnour ..... H04B 11/00 367/134
2013/0088362 A1 * 4/2013 Yates ..... G01V 3/00 340/854.3
2013/0153241 A1 * 6/2013 Mallinson ..... E21B 33/0355 166/363
2013/0283917 A1 * 10/2013 Coonrod ..... E21B 33/061 73/597
2014/0231075 A1 8/2014 Springett et al.
2015/0034298 A1 * 2/2015 Read ..... E21B 33/063 166/86.3
2016/0138385 A1 * 5/2016 Cortez ..... E21B 47/082 166/250.01

OTHER PUBLICATIONS

PCT Application No. PCT/US2016/053523, International Search Report & Written Opinion dated Jan. 9, 2017; 15 pages.

* cited by examiner

*Primary Examiner* — Clayton E Laballe
*Assistant Examiner* — Dennis Hancock
(74) *Attorney, Agent, or Firm* — Fletcher Yoder, P.C.

(57) ABSTRACT

Techniques and systems to monitor a blowout preventer. A device may include a protrusion sized to extend though an aperture of a blowout preventer. The device may also include a sensor disposed on a first end of the protrusion, wherein the sensor is configured to sense at least one condition occurring in a central bore of the blowout preventer disposed perpendicular to the aperture and generate a signal indicative of the sensed condition. The device may further include an electrical connector configured to receive the signal and transmit the signal from the device.

20 Claims, 5 Drawing Sheets

METHODS AND SYSTEMS FOR MONITORING A BLOWOUT PREVENTOR

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Advances in the petroleum industry have allowed access to oil and gas drilling locations and reservoirs that were previously inaccessible due to technological limitations. For example, technological advances have allowed drilling of offshore wells at increasing water depths and in increasingly harsh environments, permitting oil and gas resource owners to successfully drill for otherwise inaccessible energy resources. However, as wells are drilled at increasing depths, additional components may be utilized to, for example, control and or maintain pressure at the wellbore (e.g., the hole that forms the well) and/or to prevent or direct the flow of fluids into and out of the wellbore. One component that may be utilized to accomplish this control and/or direction of fluids into and out of the wellbore is a blowout preventer (BOP).

The BOP may include, for example, one or more annular BOPs and/or one or more ram BOPs. The ram BOPs may operate to seal a wellbore by, for example, fully covering the wellbore or by sealing a bore area around a drill pipe extending into the wellbore. The ram BOPs may include shear rams that operate to shear through drill pipe to, for example, regain pressure control over a wellbore. However, drill pipe typically includes tool joint sections that may be enlarged and threaded ends of joints of the drill pipe that are used to interconnect two drill pipes. The tool joints may be made of material of a higher strength than the that of the remainder of the drill pipe. Accordingly, damage to the shear rams may be encountered if the shear rams are activated when a tool joint tube (or other component) is present in a shear ram cavity. Therefore, it would be desirable to provide techniques to monitor and control one or more portions of a BOP stack to alleviate potential issues arising from the operation of one or more rams of a BOP.

DETAILED DESCRIPTION

Figure 1:
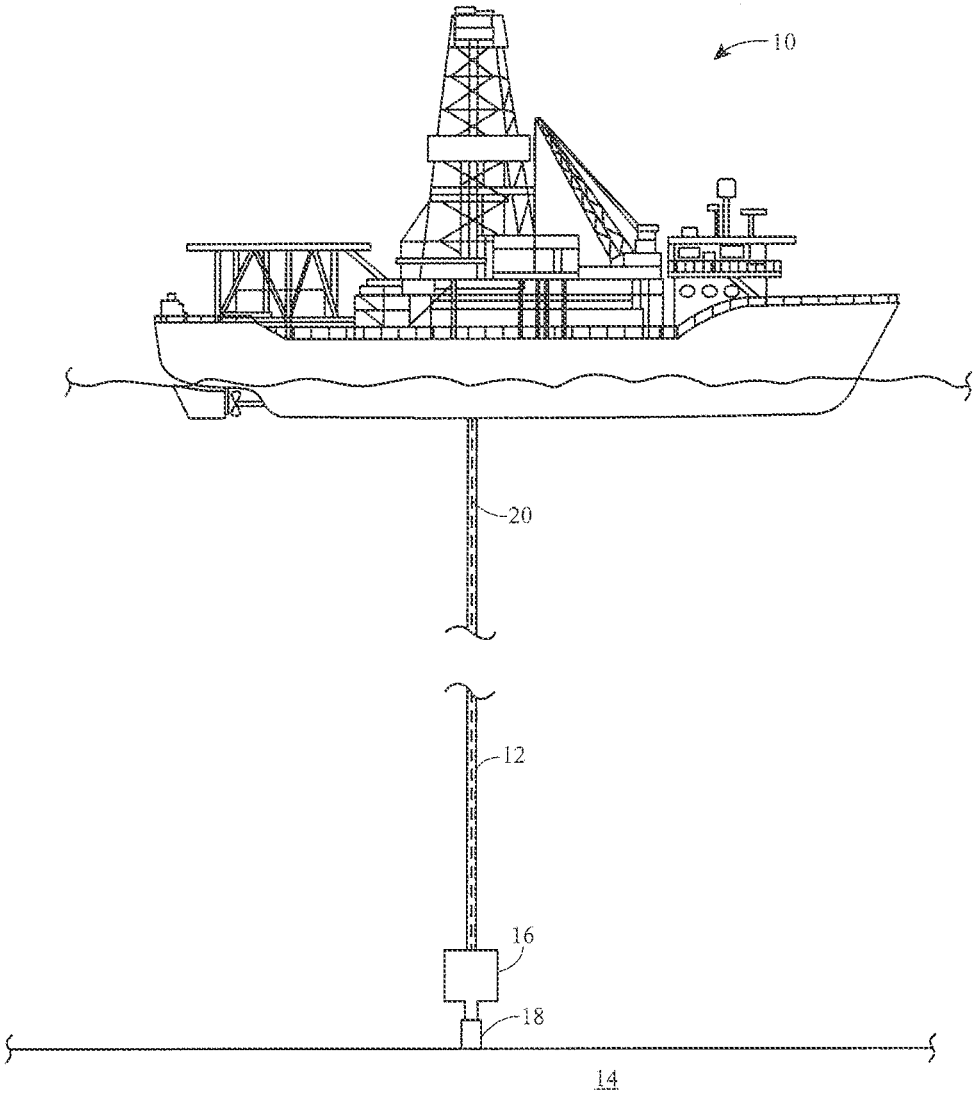
FIG. 1 illustrates an example of an offshore platform having a riser coupled to a blowout preventer (BOP), in accordance with an embodiment.

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Systems and techniques for monitoring and/or controlling a blowout preventer (BOP) are set forth below. Typically, BOPs are generally unable to shear certain portions of drill pipe, for example, tool joints. During normal drilling operation, the tool joints can be repositioned prior to activation of shear rams of the BOP. However, other events outside of normal drilling may occur. For example, an emergency disconnection of the drill pipe from the wellhead (e.g., either in a controlled manner via an emergency disconnect system or in an uncontrolled manner via failsafe devices such as a dead-man/autoshear system that operate as a fail-safe devices for the BOP close shear rams, close blind rams, activate annular preventers, or the like if the control, power, and/or hydraulic lines to the BOP have been severed or connection with the BOP at the surface has been lost) may also occur outside of normal drilling operation. In such situations, a non-shearable tool joint (or other component) may be adjacent to, for example, shear rams of the BOP. If such a situation occurs, the efficiency of the emergency system may be compromised, as the rams of the BOP may not be able to function to their full capacity to properly shut in the well as intended.

Extrapolation of the position of a location of a tool joint (or other component) in the BOP may be determined by using the position of the drill string (e.g., the length of coupled drill pipe). However, challenges to this method of determining the location of a tool joint (or other component) require accurate data of the drill string, compensation of motion of the rig from which the drill string extends, stretch of the drill string, or the like. As such, the extrapolation of the location of a tool joint (or other component) in a particular portion of a BOP is complex. Accordingly, sensors placed directly adjacent to a ram cavity of the BOP may be utilized in place of techniques to extrapolate the location of a tool joint (or other component) in a particular portion of a BOP. By placing the sensors in immediate proximity to the region being monitored, highly accurate readings may be taken and communicated, for example, to a control system to more precisely determine whether a tool joint (or other component) is in a ram cavity. This information may be utilized to reduce the closing of, for example, rams about a tool joint (or other component) and, thus, may increase the ability of a BOP to isolate a well.

With the foregoing in mind, FIG. 1 illustrates an offshore platform comprising a drillship 10. Although the presently illustrated embodiment of an offshore platform is a drillship 10 (e.g., a ship equipped with a drill rig and engaged in offshore oil and gas exploration and/or well maintenance or completion work including, but not limited to, casing and tubing installation, subsea tree installations, and well capping), other offshore platforms such as a semi-submersible platform, a spar platform, a floating production system, or the like may be substituted for the drillship 10. Indeed, while the techniques and systems described below are described in conjunction with drillship 10, the techniques and systems are intended to cover at least the additional offshore platforms described above.

As illustrated in FIG. 1, the drillship 10 includes a riser 12 extending therefrom. The riser 12 may include a pipe or a series of pipes that connect the drillship 10 to the seafloor 14 via, for example, blow out preventer (BOP) 16 that is coupled to a wellhead 18 on the seafloor 14. In some embodiments, the riser 12 may transport produced hydrocarbons and/or production materials between the drillship 10 and the wellhead 18, while the BOP 16 may include at least one valve with a sealing element to control wellbore fluid flows. In some embodiments, the riser 12 may pass through an opening (e.g., a moonpool) in the drillship 10 and may be coupled to drilling equipment of the drillship 10. As illustrated in FIG. 1, it may be desirable to have the riser 12 positioned in a vertical orientation between the wellhead 18 and the drillship 10 to allow a drill string made up of drill pipes 20 to pass from the drillship 10 through the BOP 16 and the wellhead 18 and into a wellbore below the wellhead 18.

Figure 2B:
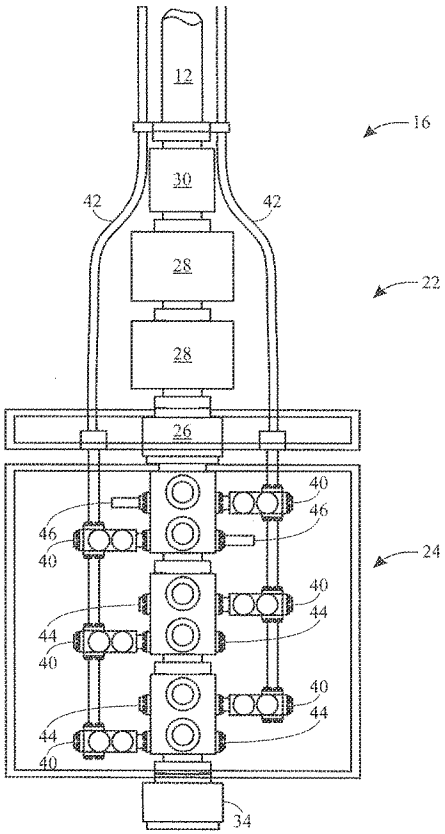
FIG. 2B illustrates a front view of the BOP of FIG. 1, in accordance with an embodiment.
Figure 2A:
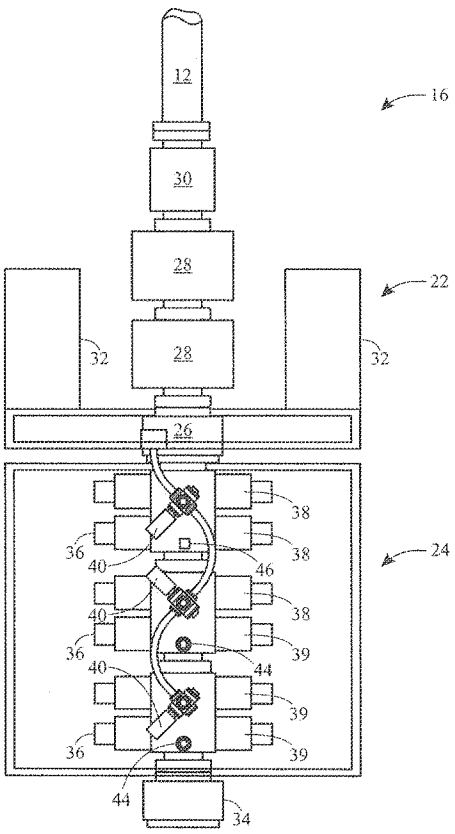
FIG. 2A illustrates a side view of the BOP of FIG. 1, in accordance with an embodiment.

FIGS. 2A and 2B illustrate a side view and a front view, respectively, of the BOP 16 of FIG. 1. As illustrated, the BOP 16 may include an upper BOP stack 22 and a lower BOP stack 24 that may operate either independently or in combination to control fluid flow into and out of a wellhead. The upper BOP stack 22 may be a lower marine riser package that includes a riser connector 26 that allows for fluid connection between the riser 12 and the lower BOP stack 24 and one or more annular BOPs 28 that may consist of a large valve used to control wellbore fluids through mechanical squeezing of a sealing element about the drill pipe 12. The upper BOP stack 22 may also include a ball/flex joint 30 that allows for angular movement of the riser 12 with respect to the BOP 16, for example, allowing for movement of the riser 12 due to movement of the drillship 10. Furthermore, the upper BOP stack 22 may include at least one control 32 (e.g., a BOP control pod) that operates as an interface between control lines that supply hydraulic and electric power and signals from the drillship 10 and the BOP 16 and/or other subsea equipment to be monitored and controlled (including the BOP 16). The control 32 and its additional functionality will be discussed in greater detail with respect to FIG. 5.

As previously noted, the BOP 16 also includes a lower BOP stack 24. The lower BOP stack 24 may be coupled to wellhead 18 via a wellhead connector 34. Furthermore, the lower BOP stack 24 may include one or more ram preventers 36. Each ram preventer 36 may include a set of opposing rams that are designed to close within a bore (e.g., a center aperture region about drill pipe 20) of the BOP 16, for example, through hydraulic operation. The ram preventers 36 may be single-ram preventers (having one pair of opposing rams), double-ram preventers (having two pairs of opposing rams), triple-ram preventers (having three pairs of opposing rams), quad-ram ram preventers (having four pairs of opposing rams), or may include additional configurations. As illustrated, the ram preventers 36 of FIGS. 2A and 2B are double-ram preventers.

Each of the ram preventers 36 may include cavities through which the respective opposing rams may pass into the bore of the BOP 16. These cavities may include, for example, shear ram cavities 38 that house shear rams (e.g., hardened tool steel blades designed to cut/shear the drill pipe 20 then fully close to provide isolation or sealing of the wellbore 16). The ram preventers 36 may also include, for example, pipe ram cavities 39 that house pipe rams (e.g., horizontally opposed sealing elements with a half-circle holes therein that mate to form a sealed aperture of a certain size through which drill pipe 20 passes) or variable bore rams (e.g., horizontally opposed sealing elements with a half-circle holes therein that mate to form a variably sized sealed aperture through which a wider range of drill pipes 20 may pass).

The lower BOP stack 24 may further include failsafe valves 40. These failsafe valves 40 may include, for example, choke valves and kill valves that may be used to control the flow of well fluids being produced by regulating high pressure fluids passing through the conduits 42 arranged laterally along the riser 12 to allow for control of the well pressure. The ram preventers 36 may include vertically disposed side outlets 44 that allow for the failsafe valves 40 to be coupled to the BOP 16. Typically, the failsafe valves 40 are arranged in a staggered configuration along the side outlets 44 of the ram preventers 36 such that the failsafe valves 40 are disposed on opposing sides of the ram preventers 38 and in separate vertical planes from one another. This configuration allows empty side outlets 44 to be present along ram preventers 36. Moreover, some of these empty side outlets 44 are disposed adjacent to (e.g., directly above and/or below) the shear ram cavities 38. As such, these empty side outlets 44 may be utilized by additional elements, for example, bore scanners 46 that may be utilized to monitor the bore of the BOP 16.

Figure 3A:
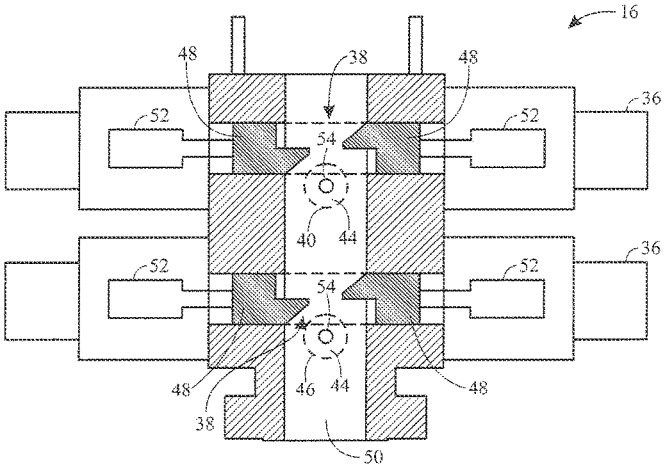
FIG. 3A illustrates a side view of a ram preventer of FIG. 2, in accordance with an embodiment.
Figure 3B:
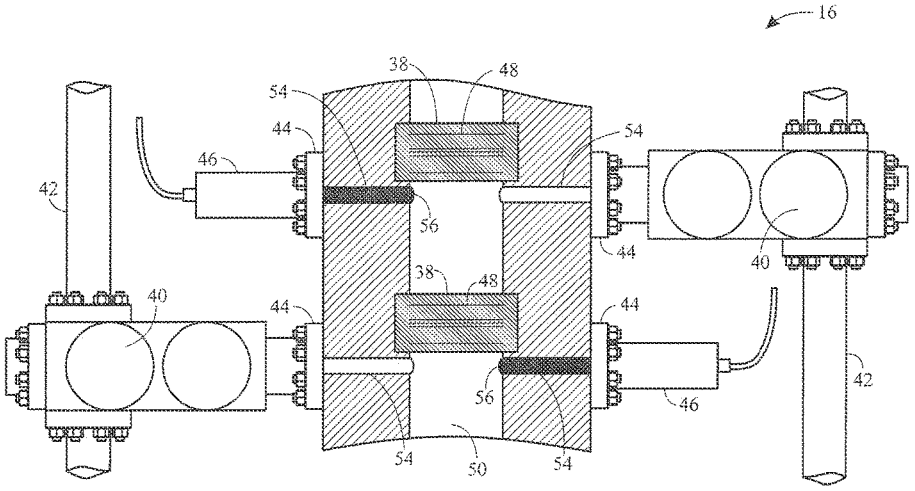
FIG. 3B illustrates a front view of ram preventer of FIG. 2, in accordance with an embodiment.
Figure 4A:
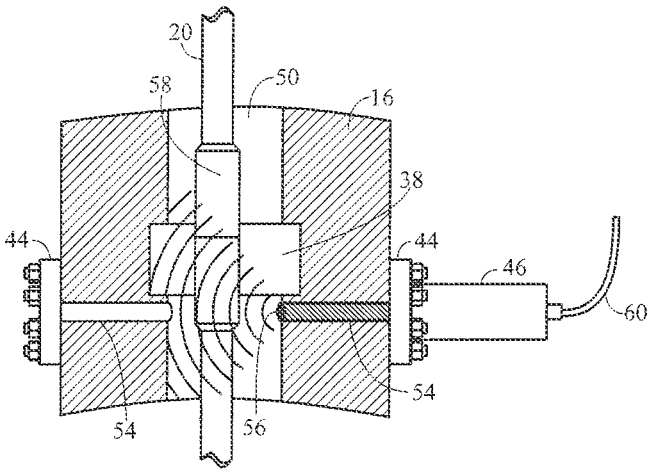
FIG. 4A illustrates a side view of the bore scanner of FIG. 2, in accordance with an embodiment.
Figure 4B:
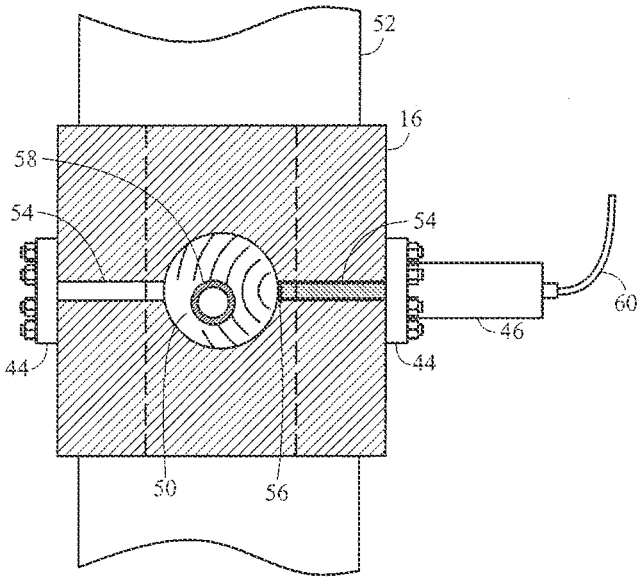
FIG. 4B illustrates a top view of the bore scanner of FIG. 2, in accordance with an embodiment.

FIGS. 3A and 3B illustrate a side view and a front view, respectively, of one of the ram preventers 36 of FIG. 2. As illustrated, the ram preventer 36 may include two pairs of horizontally opposed shear rams 48, which may include hardened tool steel blades or blades of a different material. These blades may cut/shear the drill pipe 20 and fully close across the bore 50 (e.g., the center aperture region about drill pipe 20) of the BOP 16 in the shear ram cavities 38. Actuation of the shear rams 48 may be accomplished via ram actuators 52. Additionally, as illustrated, the side outlets 44 of the ram preventer 36 may include outlet apertures 54 that are disposed directly adjacent to (e.g., directly vertically below) the shear rams 48 and the shear ram cavities 38. The outlet apertures 54 may be disposed perpendicular to the bore 50 and may extend from the bore 50 to an outer housing of the BOP 16. Additionally, the bore scanners 46 may be partially disposed in one or more of these outlet apertures 54 (e.g., the bore scanner 46 may include a protrusion or extension that is sized to fit in the outlet apertures 54), such that a sensor 56 of the bore scanner 46 (e.g., affixed to or part of the protrusion) is positioned in or immediately adjacent to and/or flush with the bore 50 of the BOP 16 immediately adjacent to (without any physical structures between) a shear ram cavity 38 of the ram preventer 36. FIGS. 4A and 4B further illustrate the location and operation of a bore scanner 46.

FIGS. 4A and 4B illustrate a side view and a top view, respectively, of one of the bore scanners 46 of FIG. 2. The bore scanner 46 may include a housing as well as an electrical connection for data communication to an acquisition (e.g., a control) system. The bore scanner 46 may also include a connection (e.g., an American Petroleum Institute (API) compatible connection) to allow installation of the bore scanner 46 on the side outlets 44. The connection may be an API 6A flanged or studded connection, or an API 16A hub connection. As illustrated, the bore scanner 46 may additionally include a sensor 56 that is positioned in the bore 50 of the BOP 16. Alternatively, the sensor 56 may be positioned adjacent to the bore 50 (e.g., flush with an edge that forms the bore 50). Furthermore, the sensor 56 may be located immediately adjacent to (without any physical structures vertically disposed between) a shear ram cavity 38 of the ram preventer 36. As illustrated, the sensor 56 may be positioned such that the shear ram cavity 38 may be monitored by the sensor 56, for example, to determine whether a tool joint 58 (e.g., an enlarged and threaded end of joints of the drill pipe 20 that are used to interconnect two drill pipes 20) is disposed in the shear ram cavity 38.

The sensor 56 may be a proximity sensor is a sensor able to detect the presence of the drill pipe 20 and/or the tool joint 58 in the shear ram cavity 38 by, for example, emitting an electromagnetic field or a beam of electromagnetic radiation and detecting changes in the field or return signal. Alternatively, an optical sensor (that operates in the visible light spectrum or operates in the non-visible light spectrum) may be utilized as the sensor 56 to determine whether the tool joint 58 is disposed in the shear ram cavity 38. Similarly, a flow sensor may be used as the sensor 56 to determine fluid flow differences caused by the tool joint 58 being disposed in the shear ram cavity 38. Likewise, additional sensor types as the sensor 56 may be employed to sense whether the tool joint 58 is disposed in the shear ram cavity 38.

Furthermore, sensor 56 may, for example, measure a diameter of any material in the shear ram cavity 38, may measure a thickness of any of any material in the shear ram cavity 38, may detect the type of material in the shear ram cavity 38, and/or may detect hydrostatic pressure of the shear ram cavity 38 to determine whether the tool joint 58 is disposed in the shear ram cavity 38. The sensor 56 may use electromagnetic transmissions, radiation, oscillating sound pressure waves, or any other appropriate technology to determine whether the tool joint 58 is disposed in the shear ram cavity 38. Accordingly, the sensor 56 may operate to generate a signal indicative of whether the tool joint 58 is disposed in the shear ram cavity 38 and the bore scanner 46 may transmit the signal (or an indication of the signal detected by the sensor) to line 60 (e.g., an electrical connection) to be used as part of the control of the BOP 16.

During operation, the bore scanners 46 may monitor various parameters for each shear ram cavity 38. For example, the bore scanner 46 (e.g., via the sensor 56) via may monitor the shape (e.g., diameter) of the tubular section that is facing the shear ram cavity 38 (e.g., monitor a drill pipe 20 tube section, a drill pipe tool joint, casing, or any other object run into the bore 50 that is disposed in the shear ram cavity 38). The bore scanner 46 (e.g., via the sensor 56) may also monitor a position of the drill pipe 20 tube section in the BOP bore 50. Additionally, the bore scanner 46 (e.g., via the sensor 56) may monitor the absolute bore pressure, the material specification and/or wall thickness of the drill pipe 20 tube section in the BOP bore 50, and/or an external/environment absolute pressure and temperature. The information monitored by the bore scanners 46 may be communicated to control systems of the BOP 16 as further discussed below with respect to FIG. 5.

Figure 5:
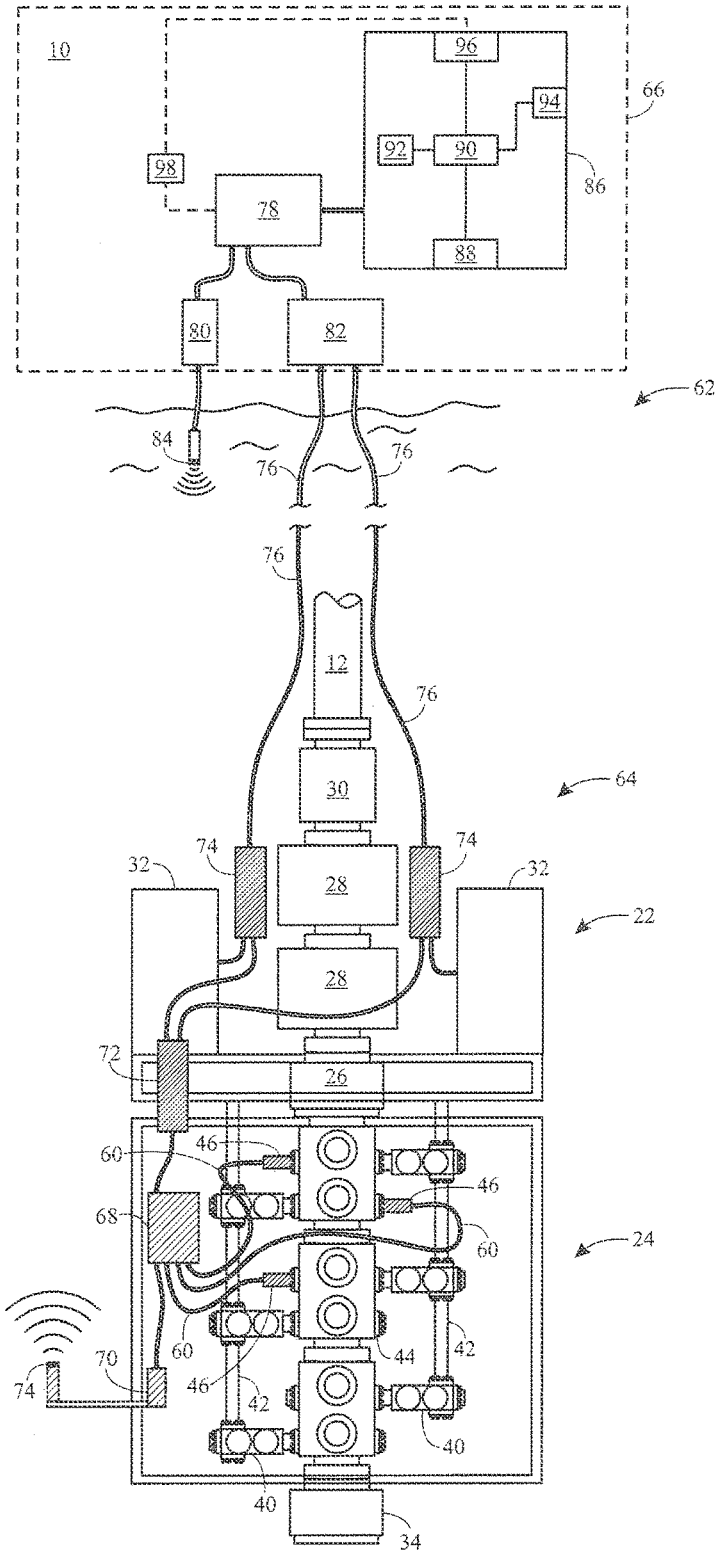
FIG. 5 illustrates a front view of a control system of the BOP of FIG. 1, in accordance with an embodiment.

FIG. 5 illustrates a control system 62 that may include a subsea control system 64 and a surface control system 66 for use with the BOP 16. The subsea control system 64 may include a subsea control monitor 68. The subsea control monitor 68 may be coupled to line 60 to receive to receive, from the bore scanner 46, a signal indicative of whether the tool joint 58 is disposed in the shear ram cavity 38 or may receive another detected or monitored signal discussed above. In some embodiments, the subsea control monitor 68 may receive signals related to the detection and monitoring undertaken by multiple bore scanners 46. For example, the subsea control module 68 may acquire all the parameters monitored by the bore scanners 46. Moreover, to reduce the amount of data provided to the surface, the subsea control module 68 may pre-analyze/compute the raw inputted data and provide the basic parameters discussed above (e.g., diameter and central position the drill pipe 20 tube section, pressures, material specifications, etc.) as an output having less data than input to the subsea control module 68. To accomplish this, the subsea control monitor 68 may include one or more processors, a controller, an application specific integrated circuit (ASIC), and/or another processing device that interacts with one or more tangible, non-transitory, machine-readable media of the subsea control monitor 68 that collectively stores instructions executable by the controller to perform the method and actions described herein. By way of example, such machine-readable media can comprise RAM, ROM, EPROM, EEPROM. CD-ROM or other optical disk storage, magnetic disk storage or other magnetic storage devices, or any other medium which can be used to carry or store desired program code in the form of machine-executable instructions or data structures and which can be accessed by the subsea control monitor 68 or by any processor, controller, ASIC, or other processing device therein.

The subsea control monitor 68 may route the signals it generates to an acoustic communication system 70 and/or an electrical connector 72. The acoustic communication system 70 may include an acoustic beacon 74 that may transmit an indication of any signals received by the subsea control monitor 68. In other embodiments, other wireless transceivers or transmitters separate from the acoustic communication system 70 may be utilized in place of or in addition to the acoustic communication system 70 to transmit indications from the subsea control monitor 68 to the drillship 10.

Electrical connector 72 may be coupled to junction box 74 and the electrical connector and the junction box may operate together to transmit indications from the bore scanners 46 to the control 32 and/or to the drillship 10, for example, via control umbilicals 76 or through a dedicated umbilical deployed along the riser 12. The control 32 may receive signals indicative of whether a tool joint 58 is disposed in a shear ram cavity 38 or other signals output from the subsea control monitor 68. Additionally, the control 32 may operate to prevent activation of the shear rams 48 for any shear ram cavity 38 having a tool joint 58 disposed therein based on the received signals for example, when communication, electrical, and/or hydraulic lines are disrupted. Additionally and/or alternatively, control of activation of the shear rams 48 may be accomplished using the surface control system 66.

The surface control system 66 may include an interface junction 78. The interface junction 78 may receive signals from acoustic junction box 80 and a surface BOP control system 82 (and/or from a dedicated umbilical deployed along the riser 12). The acoustic junction box 80 may receive signals from an acoustic beacon 84. The signals received by the acoustic beacon 84 may be communications with acoustic beacon 74 that include transmitted indications of any signals received by the subsea control monitor 68 from the one or more bore scanners 46 (e.g., signals indicative of whether the tool joint 58 is disposed in the shear ram cavity 38). These signals may be forwarded from the acoustic beacon 84 to the acoustic junction box 80 and to the interface junction 78. In other embodiments, other wireless transceivers or receivers separate from the acoustic beacon 84 may be utilized in place of or in addition to the acoustic beacon 84 and the acoustic junction box 80 to transmit indications from the bore scanners 46 to the drillship 10.

Additionally, the surface BOP control system 82 may receive indications of whether a tool joint 58 is disposed in a shear ram cavity 38 via control umbilicals 76. The BOP surface control system may forward these signals to the interface junction 78. Similarly, the interface junction 78 may transmit signals received from the acoustic junction box 80 and the surface BOP control system 82 to the computing system 86. It should be noted that the computing system 86 of drillship 10 may operate in conjunction with software systems implemented as computer executable instructions stored in a non-transitory machine readable medium of computing system 86, such as memory 88, a hard disk drive, or other short term and/or long term storage. Particularly, the techniques to determine whether to activate shear rams 48 for any shear ram cavity 38 may be performed using include code or instructions stored in a non-transitory machine-readable medium of the riser restraint device 22 (e.g., the memory 88 and/or storage) and may be executed, for example, by one or more processors 90 or a controller of computing system 86. Accordingly, computing system 86 may include an application specific integrated circuit (ASIC), one or more processors 90, or another processing device that interacts with one or more tangible, non-transitory, machine-readable media of computing system 86 that collectively stores instructions executable by the controller the method and actions described herein. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by the processor 90 or by any general purpose or special purpose computer or other machine with a processor 90.

Thus, the computing system 86 may include a processor 90 that may be operably coupled with the memory 88 to perform various algorithms. Such programs or instructions executed by the processor(s) 90 may be stored in any suitable article of manufacture that includes one or more tangible, computer-readable media at least collectively storing the instructions or routines, such as the memory 88. Additionally, the computing system 86 may include a display 92 may be a liquid crystal display (LCD) or other type of display that allows users to view images generated by the computing system 86. The display 92 may include a touch screen, which may allow users to interact with a user interface of the computing system 86.

The computing system 86 may also include one or more input structures 94 (e.g., a keypad, mouse, touchpad, one or more switches, buttons, or the like) to allow a user to interact with the computing system 86, such as to start, control, or operate a GUI or applications running on the computing system 86. Additionally, the computing system 86 may include network interface 96 to allow the computing system 86 to interface with various other electronic devices. The network interface 96 may include a Bluetooth interface, a local area network (LAN) or wireless local area network (WLAN) interface, an Ethernet connection, or the like.

The computing system 86 may receive indications of whether a tool joint 58 is disposed in a shear ram cavity 38. In some embodiments, these indications may cause the computing system to generate an alarm that may, for example, be displayed on display 92. Additionally and/or alternatively, the computing system 86 may have stored thereon a list of drill pipe 20 tubulars planned to be utilized during the operation along with their characteristics, such as external diameter, thickness, material etc. Based on this list, and the parameters monitored by the bore scanners 46, the acquisition and computing system may constantly identify and display which tubular and which section of tubular is facing each shear ram 48. This information may also be displayed to a user on the display 92.

Additionally, in some embodiments, one or more indications of whether a tool joint 58 is disposed in a shear ram cavity 38 may be visually provided to a user. For example, a display indicator 98 (e.g., a colored light or a similar indicator) may be utilized to provide a user with a visual indication of whether a tool joint 58 is disposed in a shear ram cavity 38. For example, the display indicator 98 may be red when a tool joint is present in a shear ram cavity 38, indicating to a user that shear rams 48 are not to be activated. Likewise, the display indicator 98 may be green when a tool joint is not present in a shear ram cavity 38, indicating to a user that shear rams 48 may be activated. This may aid the user in initiating shut down procedures involving the BOP 16.

This written description uses examples to disclose the above description to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Accordingly, while the above disclosed embodiments may be susceptible to various modifications and alternative forms, specific embodiments have been shown by way of example in the drawings and have been described in detail herein. However, it should be understood that the embodiments are not intended to be limited to the particular forms disclosed. Rather, the disclosed embodiment are to cover all modifications, equivalents, and alternatives falling within the spirit and scope of the embodiments as defined by the following appended claims.

What is claimed is:

1. A device, comprising:

a protrusion sized to extend though an aperture of a blowout preventer that is circumferentially offset from a ram of the blowout preventer;

a sensor disposed on a first end of the protrusion, wherein the sensor is configured to sense at least one condition occurring in a central bore of the blowout preventer indicative of a component present in an area of the central bore that prevents the ram from fully closing within the central bore to provide a seal and configured to generate a signal indicative of the sensed condition;

an electrical connector configured to receive the signal and transmit the signal from the device; and a releasable connection compatible with a side outlet disposed on an external portion of the blowout preventer, wherein the releasable connection is configured to removably couple the device to the blowout preventer by coupling the releasable connection to the side outlet, wherein the protrusion is disposed in the aperture when the releasable connection is coupled to the side outlet, wherein the protrusion is removed from the aperture when the device is decoupled and removed from the blowout preventer subsequent to decoupling of the releasable connection from the side outlet.

2. The device of claim 1, wherein the releasable connection comprises a flanged or a studded connection.

3. The device of claim 1, wherein the releasable connection comprises a hub connection.

4. The device of claim 1, wherein the sensor is configured to detect the least one condition in a ram cavity of the blowout preventer as the area of the central bore.

5. The device of claim 4, wherein the sensor is configured to detect a type of material present in the ram cavity as the at least one condition.

6. The device of claim 4, wherein the sensor is configured to detect a hydrostatic pressure in the ram cavity as the least one condition.

7. The device of claim 4, wherein the sensor is configured to detect a shape of a material present in the ram cavity as the least one condition.

8. The device of claim 4, wherein the sensor is configured to detect a position of a drill pipe tube section in the ram cavity or in the central bore as the least one condition.

9. The device of claim 4, wherein the sensor is configured to detect absolute bore pressure, a material specification of a drill pipe tube section in the ram cavity or in the central bore, a wall thickness of a drill pipe tube section in the ram cavity or in the central bore, environmental absolute pressure, or environmental temperature as the least one condition.

10. The device of claim 1, wherein the protrusion is sized to extend though the aperture of the blowout preventer into a position perpendicular to the ram of the blowout preventer.

11. A system, comprising:

a device, comprising:

a protrusion sized to extend though an aperture of a blowout preventer that is circumferentially offset from a ram of the blowout preventer;

a sensor disposed on a first end of the protrusion, wherein the sensor is configured to sense at least one condition occurring in a central bore of the blowout preventer indicative of a component present in an area of the central bore that prevents the ram from fully closing within the central bore to provide a seal and configured to generate a signal indicative of the sensed condition; and an electrical connector configured to receive the signal and transmit the signal from the device;

a releasable connection compatible with a side outlet disposed on an external portion of the blowout preventer, wherein the releasable connection is configured to removably couple the device to the blowout preventer by coupling the releasable connection to the side outlet, wherein the protrusion is disposed in the aperture when the releasable connection is coupled to the side outlet, wherein the protrusion is removed from the aperture when the device is decoupled and removed from the blowout preventer subsequent to decoupling of the releasable connection from the side outlet; and a control system configured to receive the signal from the device.

12. The system of claim 11, comprising a control monitor configured to analyze raw data present in the signal and generate an output based on the raw data.

13. The system of claim 12, wherein the control monitor is configured to generate the output as having less data than that present in the raw data.

14. The system of claim 12, wherein the control monitor is configured to route the output to a second control system of the blowout preventer.

15. The system of claim 12, wherein the control monitor is configured to route the output to an acoustic communication system for transmission to a second control system.

16. The system of claim 15, wherein the second control system is configured to receive the output and display an indication related to whether a tool joint as the component is present in a ram cavity of the blowout preventer as the area of the central bore.

17. The system of claim 12, wherein the control monitor is configured to route the output to a second control system of an offshore platform.

18. The system of claim 11, wherein the protrusion is sized to extend though the aperture of the blowout preventer into a position perpendicular to the ram of the blowout preventer.

19. The system of claim 11, wherein the sensor is disposed in a vertically adjacent plane relative to the ram of the blowout preventer.

20. A system, comprising:

a blowout preventer comprising a plurality of side outlets, wherein each side outlet of the plurality of side outlets is configured to couple a failsafe valve to the blowout preventer; and a device, comprising:

a protrusion sized to extend though an aperture of a blowout preventer that is disposed in a vertically adjacent plane relative to the ram of the blowout preventer;

a sensor disposed on a first end of the protrusion, wherein the sensor is configured to sense at least one condition occurring in a central bore of the blowout preventer indicative of a component present in an area of the central bore that prevents the ram from fully closing within the central bore to provide a seal and configured to generate a signal indicative of the sensed condition;

an electrical connector configured to receive the signal and transmit the signal from the device; and a connection compatible with each side outlet of the plurality of side outlets, wherein the connection is configured to couple the device to the blowout preventer via at least one side outlet of the plurality of side outlets.

* * * * *